US009519238B2

(12) United States Patent
Katagiri et al.

(10) Patent No.: US 9,519,238 B2
(45) Date of Patent: Dec. 13, 2016

(54) IMAGE FORMING APPARATUS WITH PHOTOCONDUCTOR DRUM PRESERVATION

(71) Applicant: CANON KABUSHIKI KAISHA, Tokyo (JP)

(72) Inventors: Shinji Katagiri, Yokohama (JP); Shuichi Tetsuno, Kawasaki (JP); Masaru Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/954,717

(22) Filed: Nov. 30, 2015

(65) Prior Publication Data

US 2016/0154334 A1 Jun. 2, 2016

(30) Foreign Application Priority Data

Dec. 2, 2014 (JP) ..... PCT/JP2014/081850

(51) Int. Cl.

| | |
|---|---|
| ***G03G 15/00*** | (2006.01) |
| ***G03G 15/01*** | (2006.01) |
| ***G03G 15/16*** | (2006.01) |

(52) U.S. Cl.

CPC ..... *G03G 15/0131* (2013.01); *G03G 15/0189* (2013.01); *G03G 15/161* (2013.01); *G03G 15/1605* (2013.01); *G03G 15/1615* (2013.01)

(58) Field of Classification Search

CPC ..... G03G 15/0131; G03G 15/1605; G03G 15/161; G03G 15/1615; G03G 15/1675; G03G 15/0189

USPC ..... 399/66, 85, 299, 302, 308, 314

See application file for complete search history.

(56) References Cited

U.S. PATENT DOCUMENTS

| | | | | |
|---|---|---|---|---|
| 6,421,521 | B2 * | 7/2002 | Tanaka | G03G 15/0131 399/299 |
| 8,909,111 | B2 * | 12/2014 | Kawaguchi | G03G 15/162 399/302 |
| 2013/0259506 | A1 * | 10/2013 | Katagiri | G03G 15/1675 399/66 |

FOREIGN PATENT DOCUMENTS

| | | | |
|---|---|---|---|
| JP | 2008116827 | A | 5/2008 |
| JP | 2010197427 | A | 9/2010 |
| JP | 2013033205 | A | 2/2013 |
| JP | 2013130662 | A | 7/2013 |
| JP | 2013213995 | A | 10/2013 |
| JP | 2013231942 | A | 11/2013 |
| JP | 2013231948 | A | 11/2013 |

* cited by examiner

*Primary Examiner* — Walter L. Lindsay, Jr.
*Assistant Examiner* — Jessica L Eley
(74) *Attorney, Agent, or Firm* — Canon U.S.A., Inc., IP Division

(57) ABSTRACT

An image forming apparatus that adjusts the electric current supplied from a second transfer member to suppress acceleration of abrasion of a photoconductor drum while maintaining the second transfer efficiency at a desired level.

11 Claims, 8 Drawing Sheets

IMAGE FORMING APPARATUS WITH PHOTOCONDUCTOR DRUM PRESERVATION

TECHNICAL FIELD

The present invention relates to image forming apparatuses that form images with electrophotography such as a photocopier, a printer, a fax machine, and a multifunctional machine.

BACKGROUND ART

Examples of an apparatus for forming images through an electrophotographic image forming process that is known to date include an image forming apparatus having a configuration including an intermediate transfer member. This image forming apparatus uniformly charges the surface of a drum-shaped electrophotographic photoconductor (hereinafter referred to as a photoconductor drum) with electricity at first using a charging unit (hereinafter referred to as a charging roller). Then, the image forming apparatus exposes the photoconductor drum with light to form an electrostatic latent image and then renders the electrostatic latent image visible (develops the electrostatic latent image) with toner using a developing unit.

Subsequently, as a first transfer process, the image forming apparatus transfers a toner image formed on the surface of the photoconductor drum to the intermediate transfer member and repeatedly transfers toner images of multiple different colors to the intermediate transfer member to form the toner images of multiple colors on the surface of the intermediate transfer member. Subsequently, as a second transfer process, the image forming apparatus supplies a voltage to a second transfer member from a high voltage power supply to collectively transfer the toner images of multiple colors formed on the intermediate transfer member to the surface of a transfer medium such as a paper sheet. The collectively transferred toner images are then permanently fixed onto the transfer medium by a fixing unit, so that a color image is formed.

PTL 1 discloses a configuration that performs a first transfer using a belt-shaped member as an intermediate transfer member (hereinafter referred to as an intermediate transfer belt) and causing an electric current to flow from an electric-current supplying member, which touches the outer circumferential surface of the intermediate transfer belt, to a voltage maintenance element connected to an opposing roller. This configuration first-transfers toner images to the intermediate transfer belt by using a second transfer member as the electric-current supplying member and causing an electric current to flow from the electric-current supplying member in the circumferential direction of the intermediate transfer belt.

CITATION LIST

Patent Literature

PTL 1 Japanese Patent Laid-Open No. 2013-231942

In the configuration disclosed in PTL 1, however, the electric current supplied from the second transfer member, used as the electric-current supplying member, to each photoconductor drum through the intermediate transfer belt may vary between stations. If the electric current supplied to the photoconductor drum of a specific station is high, the photoconductor drum of the specific station is abraded to a higher degree than the photoconductor drums of other stations after repeated image formation. Specifically, after the first transfer, the surface of the photoconductor drum to which a high electric current is supplied has a surface potential that is lower in absolute value than the surface potentials of the photoconductor drums of other stations. Thus, the charging member more frequently discharges electricity. Consequently, the surface film thickness of the photoconductor drum decreases, thereby causing a problem of accelerating the degree of abrasion of the photoconductor drum.

An aspect of the invention is to provide an image forming apparatus that adjusts the electric current supplied from a second transfer member to suppress acceleration of abrasion of a photoconductor drum while maintaining the second transfer efficiency at a desired level.

SUMMARY OF INVENTION

In order to support one or more of the above-described aspects, the present disclosure provides an image forming apparatus operable in a color mode and a monochrome mode. The image forming apparatus includes a plurality of photoconductors that carry toner images; an endless intermediate transfer member that is rotatable and to which the toner images are first-transferred from the plurality of photoconductors; a plurality of contact members disposed at positions corresponding to the plurality of photoconductors, the plurality of contact members coming into contact with an inner circumferential surface of the intermediate transfer member; a second transfer member that comes into contact with an outer circumferential surface of the intermediate transfer member and second-transfers the toner images from the intermediate transfer member to a transfer medium; a stretching member that stretches the inner circumferential surface of the intermediate transfer member; and a voltage maintenance element connected to the plurality of contact members and the stretching member and maintaining a surface potential of the intermediate transfer member. The color mode is a mode in which toner images, first-transferred to the intermediate transfer member from the plurality of photoconductors using an electric current supplied from the second transfer member in a state where all the plurality of photoconductors are in contact with the intermediate transfer member, are second-transferred to a transfer medium. The monochrome mode is a mode in which a toner image, first-transferred to the intermediate transfer member from only a specific one of the photoconductors using an electric current supplied to the second transfer member in the state where all the plurality of photoconductors are in contact with the intermediate transfer member, is second-transferred to a transfer medium. A first electric current supplied from the second transfer member to the intermediate transfer member when the image forming apparatus is operated in the monochrome mode is lower than a second electric current supplied from the second transfer member to the intermediate transfer member when the image forming apparatus is operated in the color mode.

In order to support one or more of the above-described aspects, another disclosure provides an image forming apparatus operable in a first image formation mode and a second image formation mode. The image forming apparatus includes a plurality of photoconductors that carry toner images; an endless intermediate transfer member that is rotatable and to which the toner images are first-transferred from the plurality of photoconductors; a plurality of contact members disposed at positions corresponding to the plurality of photoconductors, the plurality of contact members coming into contact with an inner circumferential surface of the intermediate transfer member; a second transfer member that comes into contact with an outer circumferential surface of the intermediate transfer member and second-transfers the toner images from the intermediate transfer member to a transfer medium; a stretching member that stretches the inner circumferential surface of the intermediate transfer member; and a voltage maintenance element connected to the plurality of contact members and the stretching member and maintaining a surface potential of the intermediate transfer member. The first image formation mode is a mode in which toner images are second-transferred from the intermediate transfer member to a transfer medium at a first image formation speed. The second image formation mode is a mode in which toner images are second-transferred from the intermediate transfer member to a transfer medium at a second image formation speed lower than the first image formation speed. An electric current supplied from the second transfer member to the intermediate transfer member when the image forming apparatus is operated in the second image formation mode is lower than an electric current supplied from the second transfer member to the intermediate transfer member when the image forming apparatus is operated in the first image formation mode.

Further features of the present disclosures will become apparent from the following description of exemplary embodiments with reference to the attached drawings.

DESCRIPTION OF EMBODIMENTS

Figure 1:
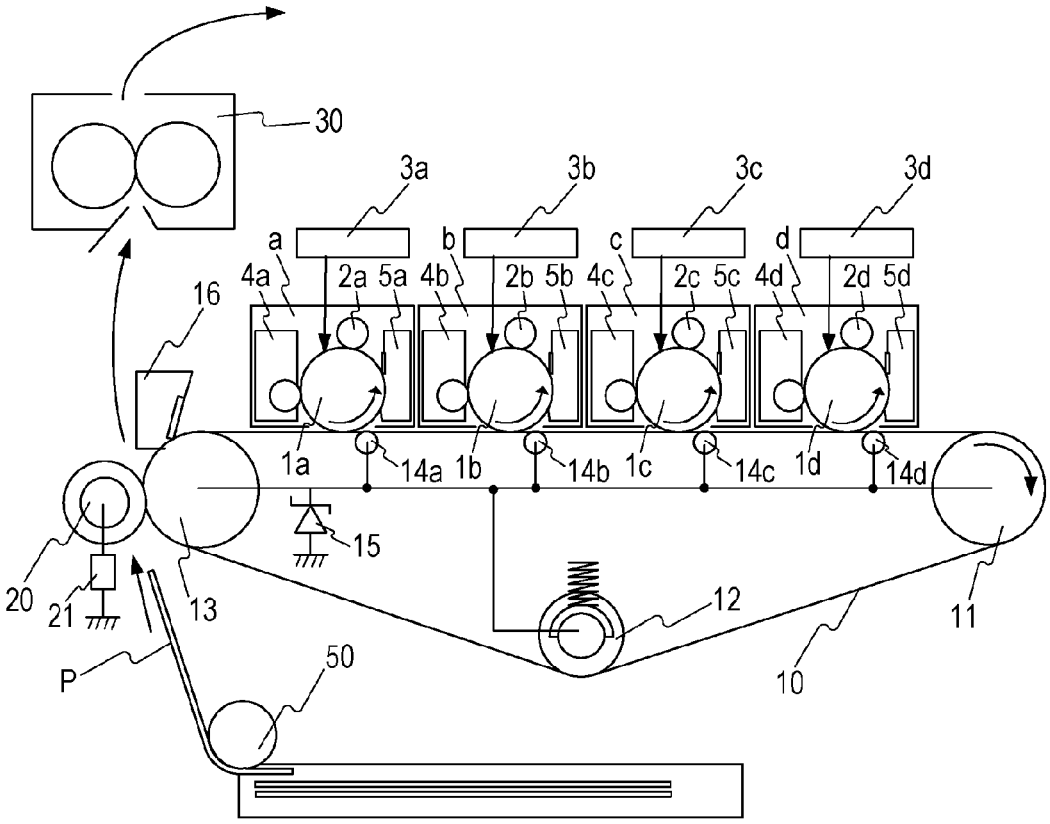
FIG. 1 illustrates an image forming apparatus according to a one embodiment of the present subject matter.

Referring now to the drawings, embodiments of the invention are exemplarily described in detail below. The dimensions, materials, shapes, and relative positions of components described below in the embodiments should be appropriately changed in accordance with the configuration of an apparatus to which the invention is applied or various other conditions. Thus, unless otherwise specifically noted, the scope of the invention is not intended to be limited to those.

First Embodiment

FIG. 1 is a schematic diagram of an example of a color image forming apparatus. The image forming apparatus is capable of forming images on transfer media, such as recording sheets or OHP sheets, with electrophotography in accordance with signals transmitted from external devices such as a personal computer communicatively connected to the image forming apparatus.

Referring to FIG. 1, the configuration and the operation of an image forming apparatus according to the embodiment are described. The image forming apparatus according to the embodiment is a so-called tandem printer including image forming stations a to d. A first image forming station a forms images of yellow (Y), a second image forming station b forms images of magenta (M), a third image forming station c forms images of cyan (C), and a fourth image forming station d forms images of black (Bk). The image forming stations have the same configuration except for the color of toner that each station contains. Hereinbelow, the first image forming station a is used for explanation.

The first image forming station a includes a drum-shaped electrophotographic photoconductor (hereinafter referred to as a photoconductor drum) 1*a*, a charging roller 2*a* serving as a charging member, a development device 4*a*, and a cleaning device 5*a*. The photoconductor drum 1*a* is an image carrier that is driven to rotate in the arrow direction at a predetermined circumferential speed (process speed) and carries a toner image. The development device 4*a* is a device that contains yellow toner to develop the yellow toner image on the photoconductor drum 1*a*. The cleaning device 5*a* is a member that recovers toner adhering to the photoconductor drum 1*a*. In this embodiment, the cleaning device 5*a* includes a cleaning blade, which is a cleaning member that comes into contact with the photoconductor drum 1*a*, and a waste toner box, which receives toner recovered by the cleaning blade.

An image forming operation is started when a controlling unit 100 (illustrated in FIG. 2) such as a controller receives image signals and then the photoconductor drum 1*a* is driven to rotate. While rotating, the photoconductor drum 1*a* is uniformly charged by the charging roller 2*a* with electricity at a predetermined potential of a predetermined polarity (negative polarity in this embodiment) and exposed to light in accordance with the image signals by an exposing unit 3*a*. Thus, an electrostatic latent image corresponding to a yellow component image of a target color image is formed. Subsequently, the electrostatic latent image is developed by the development device (yellow development device) 4*a* at the development position and rendered visible as a yellow toner image. Here, the regular polarity with which toner contained in the development device is charged is a negative polarity. In this embodiment, an electrostatic latent image is subjected to reversal development using toner electrically charged by a charging member with the same polarity as the polarity with which the photoconductor drum is electrically charged. However, the present invention is also applicable to an electrophotographic apparatus that performs charged area development on an electrostatic latent image using toner electrically charged with the polarity opposite to the polarity with which the photoconductor drum is electrically charged.

An intermediate transfer belt 10, which is an intermediate transfer member, is stretched by multiple stretching members 11, 12, and 13. The intermediate transfer belt 10 is driven to rotate in the direction so as to move in the circumferential direction at substantially the same circumferential speed as the circumferential speed of the photoconductor drum 1*a* at an opposing portion, at which the intermediate transfer belt 10 is in contact with the photoconductor drum 1*a*. Thus, the intermediate transfer belt 10 is rotatable. The stretching member 11 is a driving roller 11 that rotates the intermediate transfer belt 10 in the arrow direction. The stretching member 12 is a tension roller 12 that subjects the intermediate transfer belt 10 to tension using a spring, serving as an urging member. The stretching member 13 is an opposing roller 13 that opposes a second transfer roller 20 with the intermediate transfer belt 10 interposed therebetween.

The yellow toner image formed on the photoconductor drum 1*a* is transferred to the surface of the intermediate transfer belt 10 while passing through a contact portion (hereinafter referred to as a first transfer portion) between the photoconductor drum 1*a* and the intermediate transfer belt 10 (first transfer). Toner that remains on the surface of the photoconductor drum 1*a* after the first transfer is removed by the cleaning device 5*a* and then supplied for the image forming process from a charging operation onward.

In the same manner, the second, third, and fourth image forming stations b, c, and d respectively form a second-color magenta toner image, a third-color cyan toner image, and a fourth-color black toner image. The toner images are transferred to the intermediate transfer belt 10 so as to be sequentially stacked one on top of another, so that a combined color image corresponding to a target color image is attained.

The toner images of four colors on the intermediate transfer belt 10 are collectively transferred to the surface of a recording material P, supplied by a paper supply unit 50, in the process of passing through a second transfer portion formed by the intermediate transfer belt 10 and the second transfer roller 20 (second transfer). Thereafter, the recording material P carrying the toner images of four colors is introduced into a fixing device 30, at which the recording material P is heated and pressed, so that the toner of four colors is melted and mixed together and then fixed to the recording material P. Toner remaining on the intermediate transfer belt 10 after the second transfer is removed by a cleaning device 16. With the above-described operation, a full-color print image is formed.

Figure 2:
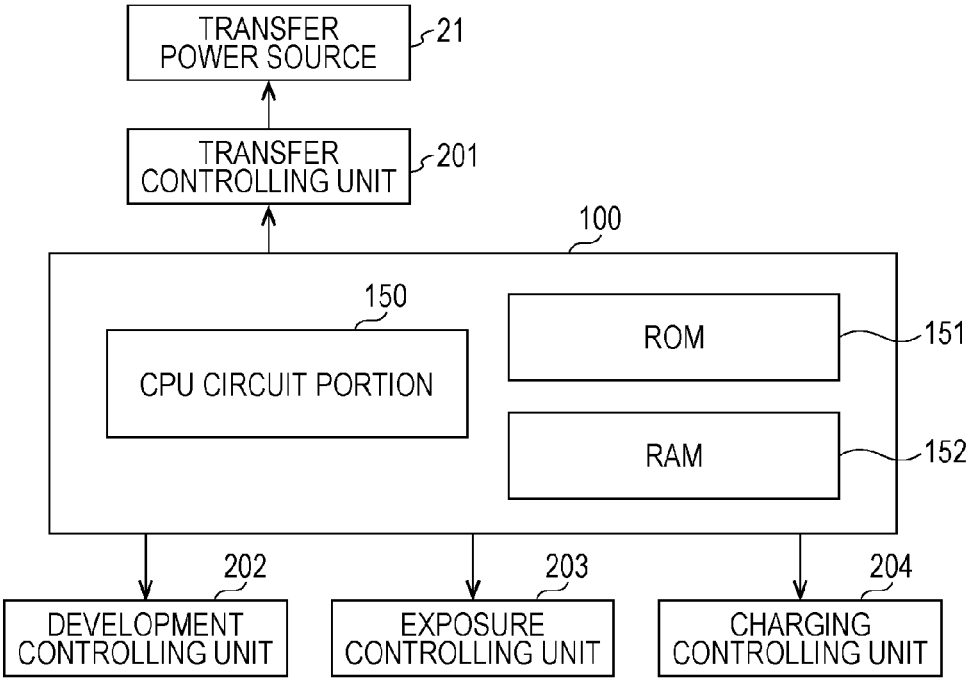
FIG. 2 is a block diagram of controlling units of an image forming apparatus.

Referring to FIG. 2, the configuration of the controller 100 that controls the entirety of the image forming apparatus is described. As illustrated in FIG. 2, the controller 100 includes a CPU circuit portion 150. The CPU circuit portion 150 has a built-in ROM 151 and a built-in RAM 152. The CPU circuit portion 150 centrally controls a transfer controlling unit 201, a development controlling unit 202, an exposure controlling unit 203, and a charging controlling unit 204 in accordance with a control program stored in the ROM 151. An environment table or a paper thickness correspondence table is stored in the ROM 151 and invoked and updated by a CPU. The RAM 152 is used for temporarily holding control data or used as a working area of calculation involved with the control. The transfer controlling unit 201 controls the transfer power source 21 in such a manner that a voltage output from the transfer power source 21 is controlled on the basis of an electric current detected by an electric current detection circuit, not illustrated. Upon receipt of image data and a print command from a host computer (not illustrated), the controller 100 controls each controlling unit (the transfer controlling unit 201, the development controlling unit 202, the exposure controlling unit 203, and the charging controlling unit 204) and performs an image forming operation required for the printing operation.

The following describes the intermediate transfer belt 10, metal rollers 14*a*, 14*b*, 14*c*, and 14*d*, which are contact members that come into contact with the inner circumferential surface of the intermediate transfer belt 10, and a voltage maintenance element 15, which are necessary for forming a first transfer potential at each first transfer portion. The metal rollers 14*a*, 14*b*, 14*c*, and 14*d* are located at positions corresponding to the photoconductor drums 1*a*, 1*b*, 1*c*, and 1*d* with the intermediate transfer belt 10 interposed therebetween, the positions being located downstream of the respective first transfer portions by a predetermined distance in a direction in which the belt moves. The driving roller 11, the tension roller 12, the second-transfer opposing roller 13, and the metal rollers 14*a*, 14*b*, 14*c*, and 14*d*, which stretch the intermediate transfer belt 10, are grounded via the voltage maintenance element 15.

The intermediate transfer belt 10 serving as an intermediate transfer member is located at a position facing the image forming stations a to d. The intermediate transfer belt 10 is an electrically conductive endless belt attained by adding a conducting agent to a resin material. The intermediate transfer belt 10 is stretched at three shafts, that is, the driving roller 11, the tension roller 12, and the second-transfer opposing roller 13. The intermediate transfer belt 10 is stretched under a tension of 60 N in total pressure by the tension roller 12. The intermediate transfer belt 10 used in the embodiment is formed of an endless member made of polyimide resin into which a carbon is mixed as a conducting agent and having a circumferential length of 700 mm and a thickness of 90 μm. Although polyimide resin is used as a material of the intermediate transfer belt 10 in this embodiment, the material of the intermediate transfer belt 10 may be another material as long as the material is thermoplastic resin. For example, materials such as polyester, polycarbonate, polyarylate, acrylonitrile-butadiene-styrene copolymer (ABS), polyphenylene sulfide (PPS), and polyvinylidene fluoride (PVdF) or resin of mixture of these materials may be used. Usable examples as a conducting agent other than carbon include electrically conductive metallic oxide particles and ion conducting agents.

Figure 3:
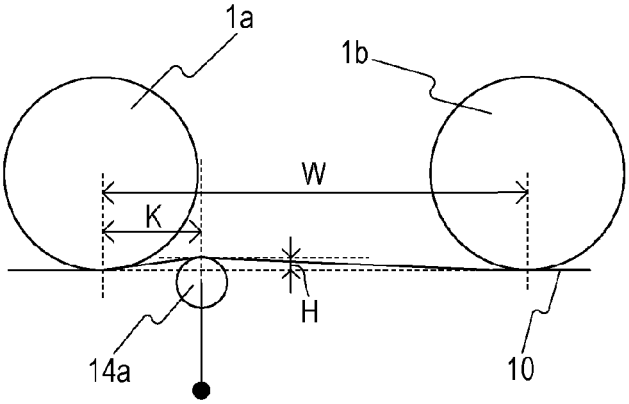
FIG. 3 is an enlarged diagram of the configuration of an image forming station.

Referring to FIG. 3, the configuration of the above-described metal roller is described in detail. FIG. 3 is an enlarged diagram of the configuration of the first image forming station a among the stations illustrated in FIG. 1. In FIG. 3, the metal roller 14*a* is located at a position downstream of the center position of the photoconductor drum 1*a* by 8 mm in the direction in which the intermediate transfer belt 10 moves. In addition, the metal roller 14*a* is located at a position 1 mm higher than the horizontal plane defined by the photoconductor drum 1*a* and the intermediate transfer belt 10 so that a certain amount of the intermediate transfer belt 10 is securely wound around the photoconductor drum 1*a*. The positioning of the metal rollers 14*a*, 14*b*, 14*c*, and 14*d* is determined in consideration of damages that can be caused due to a contact with the photoconductor drums 1*a*, 1*b*, 1*c*, and 1*d* in terms of how far the metal rollers 14*a*, 14*b*, 14*c*, and 14*d* are spaced apart from the photoconductor drums 1*a*, 1*b*, 1*c*, and 1*c* and in consideration of the stability of the potential of the intermediate transfer belt in terms of how close the metal rollers 14*a*, 14*b*, 14*c*, and 14*d* are located to the photoconductor drums 1*a*, 1*b*, 1*c*, and 1*c*.

In this embodiment, W=60 mm, K=8 mm, and H=1 mm, where the distance between the photoconductor drum 1*a* of the first image forming station a and the photoconductor drum 1*b* of the second image forming station b is denoted by W, the offset distance of the metal roller 14*a* is denoted by K, and the height by which the metal roller 14*a* is raised with respect to the intermediate transfer belt 10 is denoted by H. The metal roller 14*a* is formed of a nickel-plated stainless-steel straight round bar having an outer diameter of 6 mm. The metal roller 14*a* is driven to rotate in association with the rotation of the intermediate transfer belt 10. The metal roller 14*b* disposed in the second image forming station b, the metal roller 14*c* disposed in the third image forming station c, and the metal roller 14*d* disposed in the fourth image forming station d also have the same configuration as that of the metal roller 14*a*.

The intermediate transfer belt 10 according to the embodiment has a volume resistivity of $1\times10^9$ Ω·cm. The volume resistivity is measured by using Hiresta-UP (MCP-HT450) and type UR of ring probe (model MCP-HTP12) from Mitsubishi Chemical Corporation. Measurement conditions include a room temperature of 23° C., a room humidity of 50%, an applied voltage of 100 [V], and a measurement period of 10 secs. In this embodiment, intermediate transfer belts usable as the intermediate transfer belt 10 are those having a volume resistivity within the range of $1\times10^7$ to $10^{10}$ Ω·cm. Here, the volume resistivity is a measure of the electric conductivity as a material of the intermediate transfer belt. Whether the belt is capable of causing a desired first transfer potential when actually allowing an electric current to pass therethrough in the circumferential direction significantly depends on the degree of resistance in the circumferential direction.

Figure 4A:
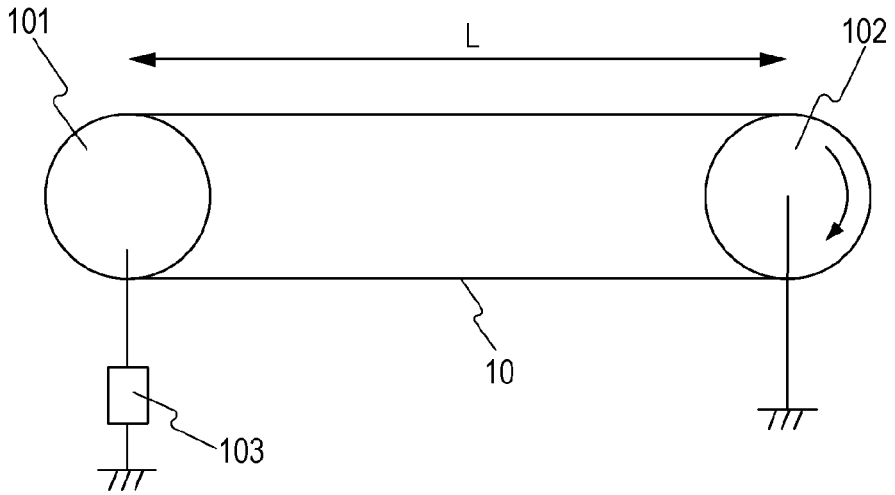
FIG. 4A illustrates a system for measuring the resistance of the intermediate transfer belt.

The circumferential resistance of the intermediate transfer belt 10 was measured using a device for measuring the circumferential resistance illustrated in FIG. 4A. Firstly, the configuration of the device is illustrated. The intermediate transfer belt 10 that is to be subjected to measurement is stretched by an inner surface roller 101 and a driving roller 102 so as to have no slack. The inner surface roller 101 made of metal is connected to a high voltage power supply (the TREK high voltage power supply of Model 610E) 103. The driving roller 102 is grounded. The surface of the driving roller 102 is covered with electrically conductive rubber having a resistance sufficiently lower than that of the intermediate transfer belt 10. The intermediate transfer belt 10 is rotated at 100 mm/sec.

Figure 4B:
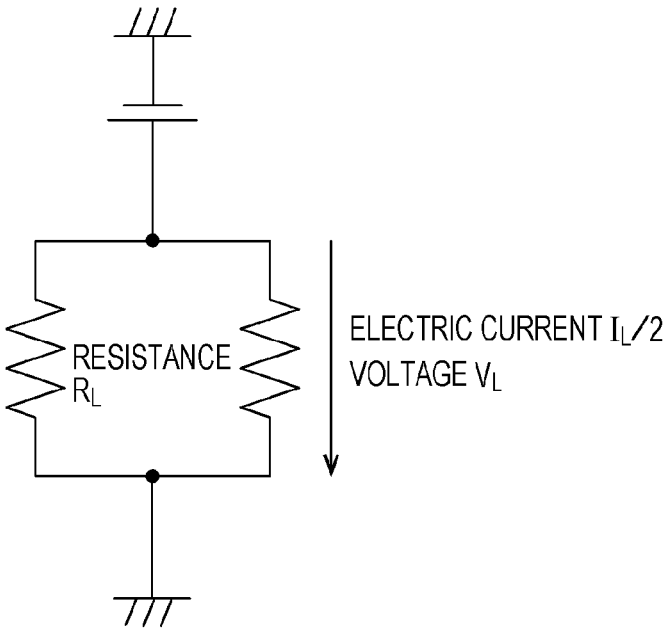
FIG. 4B illustrates an equivalent circuit of the measuring system illustrated in FIG. 4A.

Now, the measurement method is described. In the state where the intermediate transfer belt 10 is rotated at 100 mm/sec by the driving roller 102, a fixed electric current IL is applied to the inner surface roller 101 and the voltage [V] L is monitored by the high voltage power supply 103 connected to the inner surface roller 101. The measuring system illustrated in FIG. 4A can be regarded as an equivalent circuit illustrated in FIG. 4B. Thus, the circumferential resistance RL of the intermediate transfer belt 10 through the length equivalent to the distance L (300 mm in this embodiment) between the inner surface roller 101 and the driving roller 102 can be calculated by RL=2 [V]L/IL. This RL is converted into the circumferential length of the intermediate transfer belt corresponding to 100 mm of the intermediate transfer belt 10 so as to find the circumferential resistance. The circumferential resistance is preferably lower than or equal to $1\times10^9$Ω since the electric current is caused to flow from the electric-current supplying member to each photoconductor drum 1 through the intermediate transfer belt 10.

The configuration according to the embodiment includes the intermediate transfer belt 10 having a circumferential resistance value of $1\times10^6$Ω, which is found through the above-described measurement method. The intermediate transfer belt 10 according to the embodiment was measured at a fixed electric current IL of 5 μA and the monitored voltage [VL] found at that time was 3.25 [V]. The monitored voltage [VL] is found from the mean value of the overall measurement value measured throughout one round of the intermediate transfer belt 10. In addition, since RL=2 [VL]/IL, RL=$2\times3.25/(5\times10^{-6})=1.5\times10^6$Ω. When RL is converted for the case of the length corresponding to 100 mm, the circumferential resistance value is $0.5\times10^6$Ω. In this embodiment, an electrically conductive belt that allows an electric current to flow in the circumferential direction in this manner is used as the intermediate transfer belt 10.

As illustrated in FIG. 1, the driving roller 11, the tension roller 12, the second-transfer opposing roller 13 (opposing member), and the metal rollers 14*a*, 14*b*, 14*c*, and 14*d* are grounded through the voltage maintenance element 15. The voltage maintenance element 15 is an element that maintains the surface potential of the intermediate transfer belt 10. The voltage maintenance element 15 is capable of causing a potential in a member connected thereto as a result of an electric current flowing from the electric-current supplying member to the voltage maintenance element 15 through the intermediate transfer belt 10 and capable of maintaining the surface potential of the intermediate transfer belt 10. In this embodiment, a Zener diode 15, which is a voltage regulator element, is used. When a predetermined electric current flows, a predetermined voltage arises on the cathode side (hereinafter this voltage is referred to as a Zener voltage) of the Zener diode 15. In this embodiment, in order to keep the surface potential of the intermediate transfer belt 10 to a predetermined potential or higher and in order to achieve desired first transfer efficiency, the Zener voltage is set at 200 v and the predetermined electric current is set at 12 μA.

The second transfer power source 21 that applies a voltage to the second transfer roller 20 as a transfer power source is used as a common power source for performing first transfer. Thus, the second transfer roller 20 serves as an electric-current supplying member. As described above, the Zener diode 15 is connected to the second-transfer opposing roller 13 that stretches the intermediate transfer belt 10. This configuration thus enables first transfer by causing an electric current to flow from the second transfer power source 21 toward the second-transfer opposing roller 13 through the intermediate transfer belt 10. At this time, when the electric current flows to the Zener diode 15, the second-transfer opposing roller 13 has a potential corresponding to the Zener diode 15. This potential is used as an original point and the electric current is caused to flow through the metal rollers 14*a*, 14*b*, 14*c*, and 14*d*, whereby each of the image forming stations a, b, c, and d forms a first transfer potential. The potential difference between the first transfer potential and the photoconductor drum potential causes toner on the photoconductor drums 1*a*, 1*b*, 1*c*, and 1*d* to move to the intermediate transfer belt 10, so that first transfer is performed.

The second transfer roller 20 is formed of a nickel-plated steel bar having an outer diameter of 8 mm covered with a sponge foam mainly made of NBR and epichlorohydrin and adjusted to have a volume resistance of $10^8$ Ω·cm and a thickness of 5 mm so that the outer diameter of the second transfer roller 20 is 18 mm. The second transfer roller 20 comes into contact with the outer circumferential surface of the intermediate transfer belt 10 with a pressure of 50 N and forms a second transfer portion. The second transfer roller 20 is driven to rotate by the intermediate transfer belt 10. When the second transfer roller 20 is second-transferring toner on the intermediate transfer belt 10 to a recording material P such as a paper sheet, the second transfer roller 20 is controlled by the transfer power source 21 so as to have a fixed electric current.

The transfer power source 21 is connected to the second transfer roller 20 and supplies a second transfer voltage output from a transformer, not illustrated, to the second transfer roller 20. The transfer power source 21 controls the second transfer voltage so as to make the second transfer electric current substantially constant by feeding back to the transformer the difference between a predetermined control electric current and the monitored electric current, which is an actual output, using a CPU, which is a control IC for the image forming apparatus and is not illustrated. The transfer power source 21 is capable of outputting a voltage within the range of 100 [V] to 4000 [V].

This embodiment is capable of operating in a color mode in which toner images are transferred from all the photoconductor drums 1*a*, 1*b*, 1*c*, and 1*d*. In the color mode, the intermediate transfer belt 10 comes into contact with all the photoconductor drums 1*a*, 1*b*, 1*c*, and 1*d*. This embodiment is also capable of operating in a monochrome mode in which a toner image is transferred from a specific photoconductor drum 1*d*. Also in the monochrome mode, the intermediate transfer belt 10 similarly comes into contact with all the photoconductor drums 1*a*, 1*b*, 1*c*, and 1*d*. Here, although the metal rollers 14*a*, 14*b*, 14*c*, and 14*d* come into contact with the intermediate transfer belt 10 in the color mode in which toner images are transferred from all the photoconductor drums 1*a*, 1*b*, 1*c*, and 1*d*, the metal rollers 14*a*, 14*b*, 14*c*, and 14*d* also come into contact with the intermediate transfer belt 10 in the monochrome mode in which a toner image is transferred from only a specific photoconductor drum 1*d*.

In such a configuration, an electric current supplied from the second transfer roller 20 to the intermediate transfer belt 10 flows also to the unused photoconductor drums 1*a*, 1*b*, and 1*c* in the monochrome mode. Consequently, the abrasion of the photoconductor drums 1*a*, 1*b*, and 1*c* may be accelerated in the monochrome mode, whereby the photoconductor drum may require early replacement.

Specifically, as the number of times of image formation increases and the total number of rotations of each photoconductor drum 1 increases, the surface of the photoconductor drum 1 degrades due to discharge of the corresponding charging roller 2 and is abraded as a result of being slidably rubbed on the corresponding cleaning unit 5 that comes into contact with the surface, whereby the film thickness is gradually thinned. Particularly, the film thickness of the photoconductor drum 2*a* disposed adjacent to the second transfer roller 20 that supplies an electric current in the circumferential direction of the intermediate transfer belt 10 is more likely to be thinned. This is because the photoconductor drum 2*a* receives a largest amount of electric current from the second transfer portion in the circumferential direction and, after passing through the first transfer portion, the photoconductor drum 2*a* is likely to have a lower potential in absolute value than the potentials of the photoconductor drums 2*b*, 2*c*, and 2*d*. Thus, the charging roller 2*a* frequently causes electric discharge, which accelerates the drum abrasion.

Thus, in this embodiment, the first electric current supplied from the second transfer roller 20 in the monochrome mode is made lower than the second electric current supplied from the second transfer roller 20 in the color mode. By lowering the supplied electric current, the electric current flowing through the photoconductor drum 1*a* is reduced, whereby the drum abrasion is suppressed. However, a change of the electric current supplied from the second transfer roller 20 may affect the second transferability at the second transfer portion.

Figure 5:
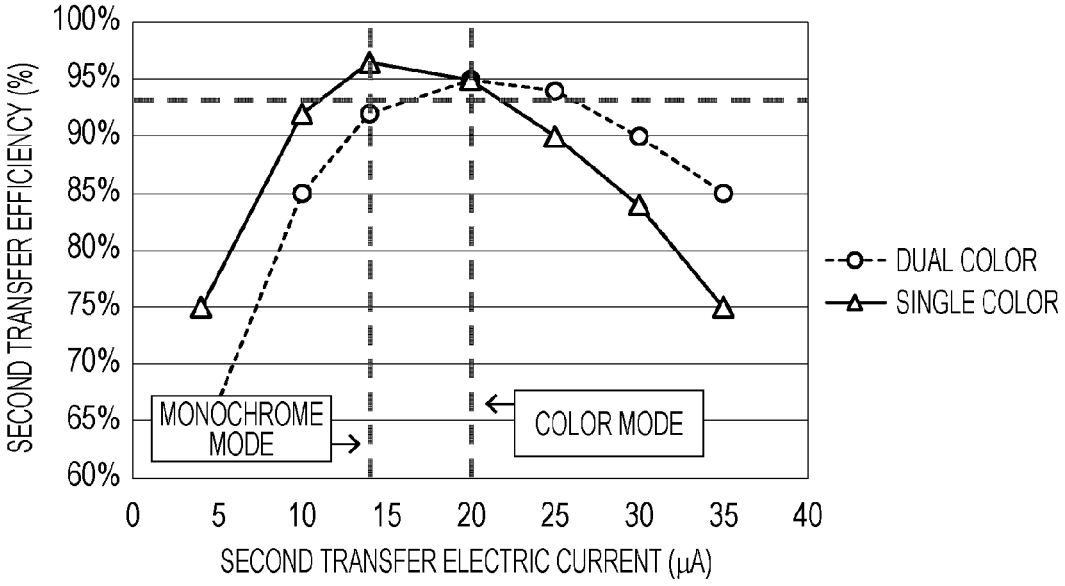
FIG. 5 illustrates the second transfer efficiency depending on the image pattern.

FIG. 5 is a graph expressing the second transfer efficiency depending on the image pattern. In the graph, the vertical axis expresses the transfer efficiency and the transverse axis expresses the second transfer electric current. The value of the transfer efficiency on the vertical axis is a conversion from the results of the second-transfer remaining density measured by a Macbeth densitometer (manufactured by GretagMacbeth) and a lower value means lower transfer efficiency. In the graph, the solid line expresses the transfer efficiency of the case of single printing and the broken line expresses the transfer efficiency of the case of superposing two colors (dual color) from among, for example, red, green, and blue.

FIG. 5 reveals that the electric current required for second transfer increases with increasing thickness of a toner layer. Thus, in the color mode, the transfer efficiency is highest at or around 20 μA in accordance with the dual-color transfer efficiency. On the other hand, in the monochrome mode in which an image is formed with only a single color, the transfer efficiency is highest at or around 14 μA in accordance with the single-color transfer efficiency. Thus, in the monochrome mode, the electric current supplied from the second transfer roller 20 is allowed to be made lower than that in the case of the color mode. Here, the supplied electric current (hereinafter referred to as a set electric current) is a target electric current when the transfer controlling unit 201 controls the transfer power source 21 so that a constant electric current control is performed at the transfer controlling unit 201. In the case of performing a constant voltage control, what has to be done is to set an applied voltage to a constant voltage so that the electric current flowing to the second transfer roller 20 attains a target electric current.

Figure 6A:
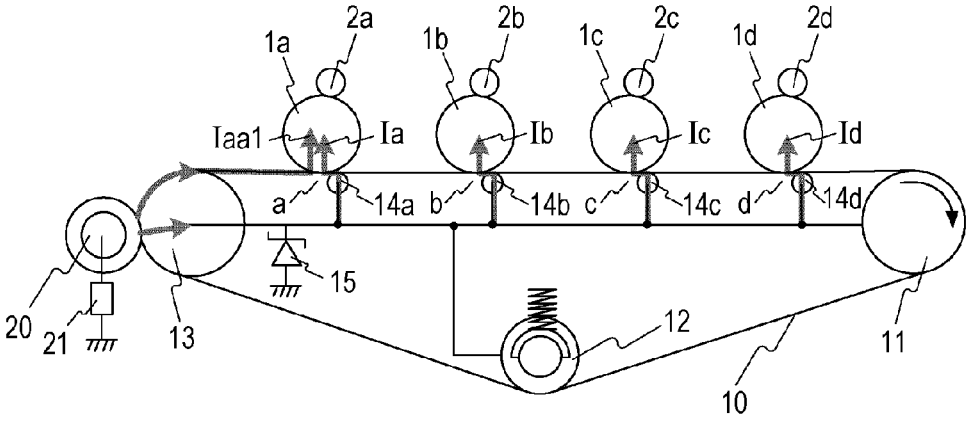
FIG. 6A illustrates an electric current path of the electric current supplied from a second transfer roller 20 when the electric current is set at 20 μA and FIG. 6B illustrates an electric current path of the electric current supplied from the second transfer roller 20 when the electric current is set at 14 μA.
Figure 6B:
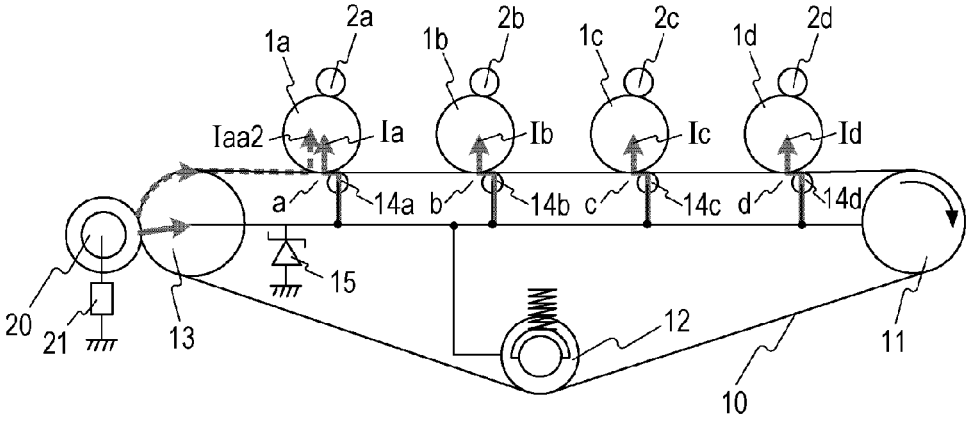

FIG. 6A illustrates an electric current path of the electric current supplied from the second transfer roller 20 when the set electric current is 20 μA. FIG. 6B illustrates an electric current path of the electric current supplied from the second transfer roller 20 when the set electric current is 14 μA.

The electric current supplied from the second transfer roller 20 is divided into the electric current that flows in the circumferential direction of the intermediate transfer belt 20 to the photoconductor drum 1*a* and the electric current that flows to the second-transfer opposing roller 13. In FIG. 6A, the electric current is divided into an electric current Iaa1 that flows to the photoconductor drum 1*a* of the first image forming station a through the intermediate transfer belt 10 and electric currents Ia, Ib, Ic, and Id that flow from the second-transfer opposing roller 13 to the photoconductor drums 1*a*, 1*b*, 1*c*, and 1*d* of the image forming stations a, b, c, and d through the corresponding metal rollers 14*a*, 14*b*, 14*c*, and 14*d*. Here, the metal rollers 14*a*, 14*b*, 14*c*, and 14*d* are set at 200 v by the Zener diode 15. Thus, the electric currents Ia, Ib, Ic, and Id have an equal electric current. Accordingly, the first image forming station a, which is the nearest station, receives the electric current that is the sum of the electric current Iaa1 that flows through the intermediate transfer belt 10 and the electric current Ia that flows from the metal roller 14*a*. Thus, the first image forming station a receives a larger amount of electric current than other image forming stations.

On the other hand, in FIG. 6B, the electric current is divided into an electric current Iaa2 that flows through the intermediate transfer belt 10 to the photoconductor drum 1*a* of the first image forming station a and electric currents Ia, Ib, Ic, and Id that flow from the second-transfer opposing roller 13 to the photoconductor drums 1*a*, 1*b*, 1*c*, and 1*d* of the image forming stations a, b, c, and d through the corresponding metal rollers 14*a*, 14*b*, 14*c*, and 14*d*. Here, when the set electric current is the rate that maintains the Zener voltage, the electric currents Ia, Ib, Ic, and Id that flow to the photoconductor drums 1*a*, 1*b*, 1*c*, and 1*d* of the image forming stations a, b, c, and d remain the same, as illustrated in FIG. 6A and FIG. 6B. Thus, the difference in electric current that flows to the photoconductor drum 1*a* between the state illustrated in FIG. 6A and the state illustrated in FIG. 6B is equal to the difference between the electric current Iaa1 and the electric current Iaa2. Thus, in the state illustrated in FIG. 6B, the electric current that flows to the photoconductor drum 1*a* in the circumferential direction of the intermediate transfer belt 10 is lower than that in the state illustrated in FIG. 6A, whereby acceleration of the degree of abrasion of the photoconductor drum 1*a* can be suppressed. From the above-described configuration, by making the electric current supplied from the second transfer roller 20 lower in the monochrome mode than in the color mode, acceleration of the degree of abrasion of the photoconductor drum 1*a* can be suppressed while the second transfer efficiency is maintained at a desired level.

To describe effects of the embodiment, the embodiment is described in comparison with Comparative Example 1 and Comparative Example 2. Table 1 illustrates, between the embodiment and the comparative examples, the set rate at the second transfer roller 20 and the second transfer efficiency in each mode and the degree of abrasion of the surface of the photoconductor drum after 3000 sheets are caused to pass over the photoconductor drum in the monochrome mode.

Here, in the configuration of Comparative Example 1, the set electric current is 20 μA in both of the monochrome mode and the color mode. Other parts of the configuration are the same as those in the first embodiment. In the configuration of the Comparative Example 2, the set electric current is 14 μA in both of the monochrome mode and the color mode. Other parts of the configuration are the same as those in the first embodiment. Printing is performed at a process speed of 100 mm/sec.

TABLE 1

| | Set Electric Current | | Second Transfer Efficiency | | Abrasion of Photoconductor Drum in |
|---|---|---|---|---|---|
| Item | Full Color | Mono-Color | Full Color | Mono-Color | Monochrome Mode |
| Comparative Example 1 | 20 μA | 20 μA | 95% | 95% | Unpreferable |
| Comparative Example 2 | 14 μA | 14 μA | 92% | 96% | Preferable |
| 1st Embodiment | 20 μA | 14 μA | 95% | 96% | Preferable |

Subsequently, the evaluation results are described. In the configuration of Comparative Example 1, the set electric current in the monochrome mode is 20 μA as in the case of that in the color mode. Thus, the second transferability in the color mode is preferable second transferability. Also in the monochrome mode, the second transferability of only a single color is slightly lowered but remains preferable transferability. In the configuration of Comparative Example 1, however, the drum surface of the photoconductor drum 1*a* increasingly degraded and after 3000 sheets passed, the photoconductor drum abrasion accelerated further than in the case of other image forming stations.

In the configuration of Comparative Example 2, the set electric current is 14 μA. Although the second transferability in the monochrome mode is preferable second transferability, the dual-color second transferability in the color mode is lowered and a transfer error has occurred. However, in contrast to the Comparative Example 1, the drum surface of the photoconductor drum 1*a* in the monochrome mode was prevented from being degraded.

Thus, by lowering the electric current supplied from the second transfer roller 20 in the operation in the monochrome mode than that in the case of the operation in the color mode, acceleration of the degree of abrasion of the photoconductor drum 1*a* can be suppressed while the second transfer efficiency is maintained at a preferable level.

In this configuration that performs first transfer with the electric current supplied from the second transfer roller 20, a change of the electric current supplied from the second transfer roller 20 also affects the first transferability. Thus, in this embodiment, the electric current supplied from the second transfer roller 20 is determined in consideration of the first transferability.

Figure 7:
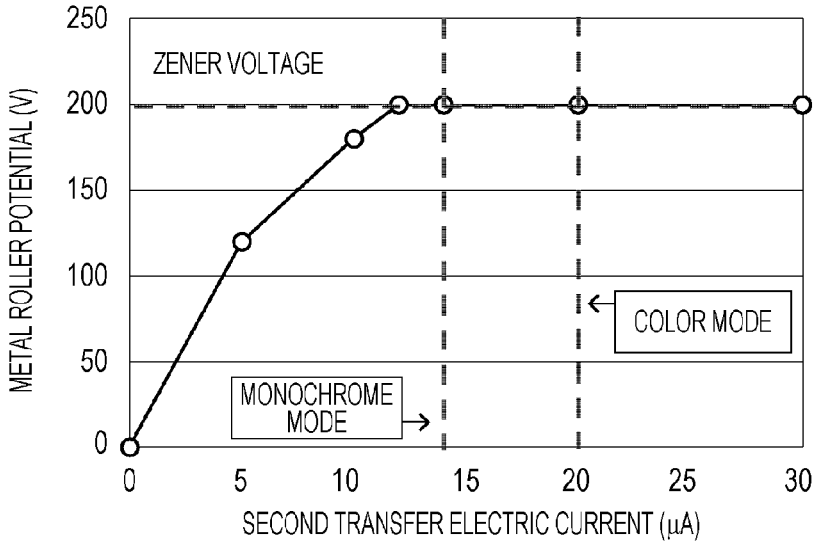
FIG. 7 illustrates the relationship between the electric current supplied from the second transfer roller 20 and the potentials of the metal rollers 14*a*, 14*b*, 14*c*, and 14*d*.

FIG. 7 illustrates the electric current supplied from the second transfer roller 20 and the potentials of the metal rollers 14*a*, 14*b*, 14*c*, and 14*d*. In the graph, the vertical axis expresses the potentials of the metal rollers 14*a*, 14*b*, 14*c*, and 14*d* and the transverse axis expresses the electric current. As illustrated in FIG. 1, the metal rollers 14*a*, 14*b*, 14*c*, and 14*d* are connected to the Zener diode 15 and have potentials as a result of receiving an electric current from the second transfer roller 20 through the intermediate transfer belt 10. Specifically, as a larger amount of electric current is supplied from the second transfer roller 20, the potential of the Zener diode 15 on the cathode side rises and, accordingly, the potentials of the metal rollers 14*a*, 14*b*, 14*c*, and 14*d* rise. When the electric current is supplied at a predetermined electric current of 12 μA or higher, the potentials of the metal rollers 14*a*, 14*b*, 14*c*, and 14*d* are fixed at 200 v. This is because the electric current exceeding 12 μA flows to the anode side of the Zener diode 15, the cathode side of the Zener diode 15 is maintained at the Zener voltage, and thus the potentials of the metal rollers 14*a*, 14*b*, 14*c*, and 14*d* connected to the cathode side are kept at 200 v.

Here, the Zener voltage is a voltage set to attain intended first transfer efficiency. Thus, by supplying the electric current of 12 μA or higher from the second transfer roller 20, the metal rollers 14*a*, 14*b*, 14*c*, and 14*d* to which the Zener diode 15 is connected can securely attain a potential of 200 v, required for first transfer. When the set electric current is lower than 12 μA, the electric current that flows from the metal rollers 14*a*, 14*b*, 14*c*, and 14*d* to the photoconductor drums 1*a*, 1*b*, 1*c*, and 1*d* falls below the values of Ia, Ib, Ic, and Id. When the electric current that flows from the metal rollers 14*a*, 14*b*, 14*c*, and 14*d* to the photoconductor drums 1*a*, 1*b*, 1*c*, and 1*d* falls below the values of Ia, Ib, Ic, and Id, intended first transferability fails to be secured. In other words, what has to be done in order to secure the intended first transferability while acceleration of the degree of abrasion of the photoconductor drum 1*a* is suppressed is to select, for the set electric current, a low value within the range higher than or equal to the set electric current that can maintain the Zener voltage.

From the above description, in this embodiment, the electric current supplied from the second transfer roller 20 is set at 20 μA in the operation in the color mode and the electric current supplied from the second transfer roller 20 is set at 14 μA in the operation in the monochrome mode. The value of 14 μA set for the monochrome mode falls within the range exceeding the electric current that maintains the Zener voltage and the electric current supplied from the second transfer roller 20 in the operation in the color mode is a value lower than 20 μA.

This configuration enables suppression of acceleration of the degree of abrasion of the photoconductor drum 1*a* and the maintenance of the first transfer efficiency and second transfer efficiency at intended levels.

What has to be done to suppress excessive electric discharge on the photoconductor drum is to prevent the absolute value of the photoconductor drum potential from being lowered after the first transfer. To this end, it is preferable in this embodiment that the voltage applied to the second transfer roller 20 be changed at the time when the voltage is applied to the charging rollers 2*a*, 2*b*, 2*c*, and 2*d* that electrically charge the corresponding photoconductor drums 1*a*, 1*b*, 1*c*, and 1*d*. In this embodiment, in the monochrome mode, the electric current supplied from the second transfer roller 20 is changed at the time when a voltage is applied to the charging roller 2*a* of the first image forming station a.

Second Embodiment

A second embodiment is different from the first embodiment in that the electric current supplied from the second transfer member, which is an electric-current supplying member, is lowered in the operation in a slow image formation mode, in which printing is more slowly performed or image formation is performed at a low speed, is performed. Other parts of the configuration are the same as those of the configuration of the image forming apparatus according to the first embodiment and thus the same portions are described using the same reference symbols.

The second embodiment has a slow image formation mode (second image formation mode) in which, when a second transfer is performed on a transfer medium such as cardboard or coated paper, image formation is performed at a lower image formation speed than in the case of a normal image formation mode (first image formation mode) in which second transfer is performed on an ordinary transfer medium. Lowering the image formation speed (transportation speed) is to secure the degree of fixity and the glossiness. The electric current supplied from the second transfer roller 20 in the operation in the slow image formation mode is made lower than the electric current supplied from the second transfer roller 20 in the operation in the normal image formation mode, so that acceleration of the degree of abrasion of the photoconductor drum 1*a* adjacent to the second transfer roller 20 is suppressed.

Figure 8:
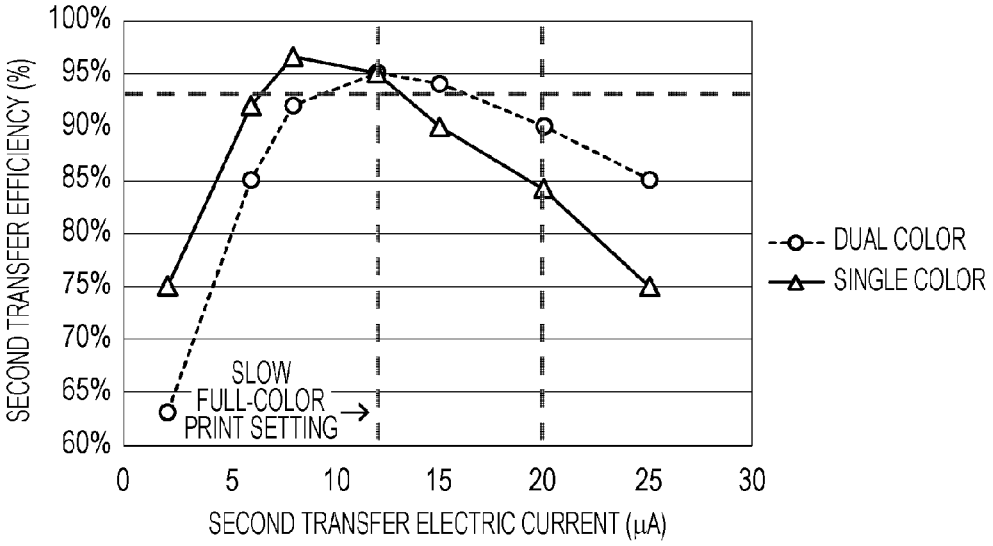
FIG. 8 illustrates the second transfer efficiency depending on the image pattern.

FIG. 8 is a graph expressing of the second transfer efficiency depending on the image pattern. In the graph, the vertical axis expresses the transfer efficiency and the transverse axis expresses the second transfer electric current. The values of the transfer efficiency on the vertical axis are conversions of the results of the second-transfer remaining density measured by a Macbeth densitometer (manufactured by GretagMacbeth) and a lower value means lower transfer efficiency. In the graph, the solid line expresses the transfer efficiency of the case of single printing and the broken line expresses the (dual color) transfer efficiency of the case of superposing two colors from among, for example, red, green, and blue.

As illustrated in FIG. 8, in the case where the operation is performed in the slow image formation mode, the set electric current was set at or around 12 μA in accordance with the dual color transfer efficiency in both of the monochrome mode and the color mode. The set electric current in the case where the operation is performed in the normal image formation mode is 14 μA or 20 μA, which is the set electric current illustrated in FIG. 5 in the first embodiment. Thus, in this embodiment, when the operation is performed in the slow image formation mode, the supplied electric current can be made lower than that in the normal image formation mode regardless of whether the operation is performed in the monochrome mode or the color mode. By lowering the supplied electric current, acceleration of the degree of abrasion of the photoconductor drum 1*a* is suppressed in the slow image formation mode.

In addition, the set electric current in the slow image formation mode is the same rate as 12 μA at which the Zener voltage rises. Thus, intended first transfer efficiency can be attained even when the electric current supplied from the second transfer roller 20 is lowered.

Table 2 illustrates, between the second embodiment and comparative example 3, the set electric current and the second transfer efficiency in each printing mode and the degree of abrasion of the photoconductor drum.

The configuration according to Comparative Example 3 is different from the configuration according to the embodiment in that the set electric current in the slow image formation mode is 20 μA in conformity with the set electric current in the normal image formation mode.

The process speed in the normal image formation mode is 100 mm/sec and the process speed in the slow image formation mode is 50 mm/sec.

TABLE 2

| | Set Electric Current from Second Transfer Member (Electric Current Supplying member) | | Second Transfer Efficiency | | Abrasion of Photoconductor |
|---|---|---|---|---|---|
| Item | Normal | Slow | Normal | Slow | Drum |
| Comparative Example 3 | 20 μA | 20 μA | 95% | 85% | Unpreferable |
| 2nd Embodiment | 20 μA | 12 μA | 95% | 95% | Preferable |

In the configuration according to Comparative Example 3, the set electric current in the slow image formation mode is 20 μA. Thus, as illustrated in FIG. 8, the second transfer efficiency was lowered. Particularly, in the monochrome mode, the set electric current was lowered to as low as 85%. In the configuration according to Comparative Example 3, the electric current of 20 μA was supplied also in the slow image formation mode, so that the degree of abrasion of the photoconductor drum 1*a* was accelerated.

In the configuration according to the second embodiment, the set electric current in the slow image formation mode is 12 μA. Thus, acceleration of the degree of abrasion of the photoconductor drum 1*a* can be suppressed since the supplied electric current is lowered while the second transfer efficiency is maintained as illustrated in FIG. 8. In addition, since the set electric current is the same as the electric current at which the Zener voltage rises, intended first transfer efficiency can be attained.

Other Embodiments

Figure 9:
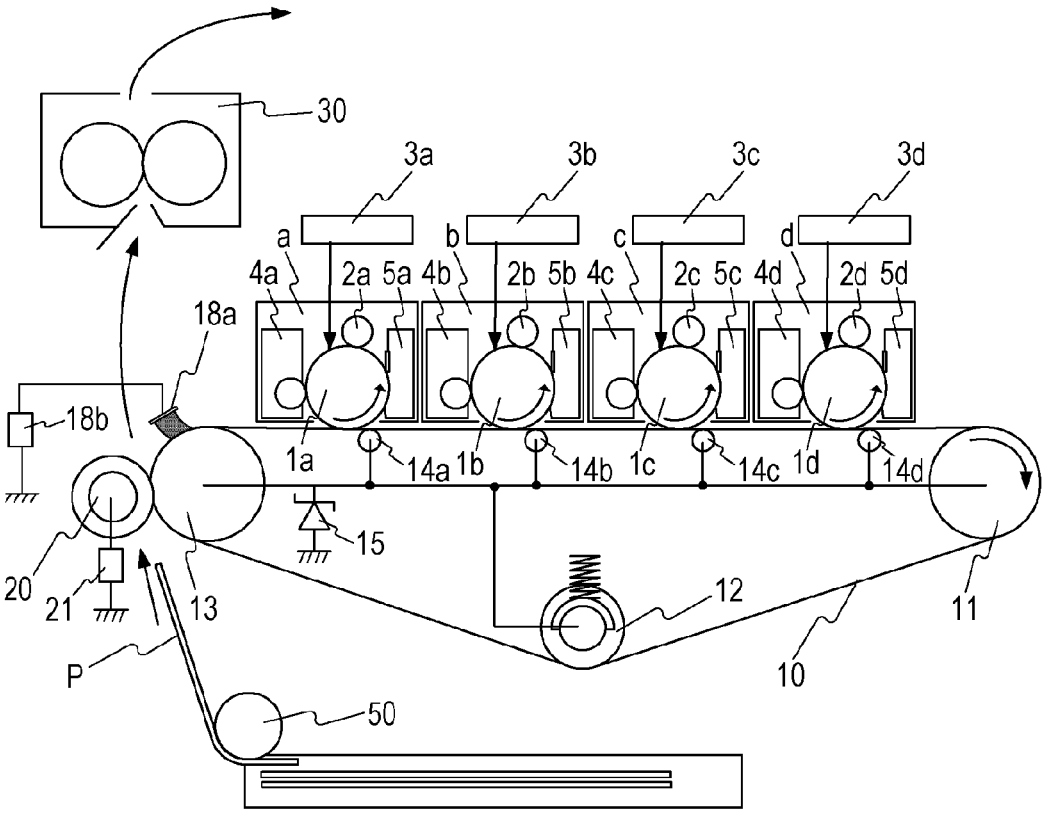
FIG. 9 illustrates an image forming apparatus according to another embodiment of the present subject matter.

The above-described embodiments have described a configuration in which the second transfer roller 13 is solely used as an electric-current supplying member. However, another member may be additionally provided as an electric-current supplying member. For example, FIG. 9 illustrates an image forming apparatus according to another embodiment that includes a charging brush 16*a*, which electrically charges toner remaining on the intermediate transfer belt 10 after the second transfer, and a charging power source 18*b*, which applies a voltage to the charging brush 16*a*. In the image forming apparatus illustrated in FIG. 9, the output of the charging power source 18*b* is changed in synchronization with the time when the output of the transfer power source 21 is changed, so that the effects similar to those according to the first embodiment or the second embodiment can be attained.

Figure 10:
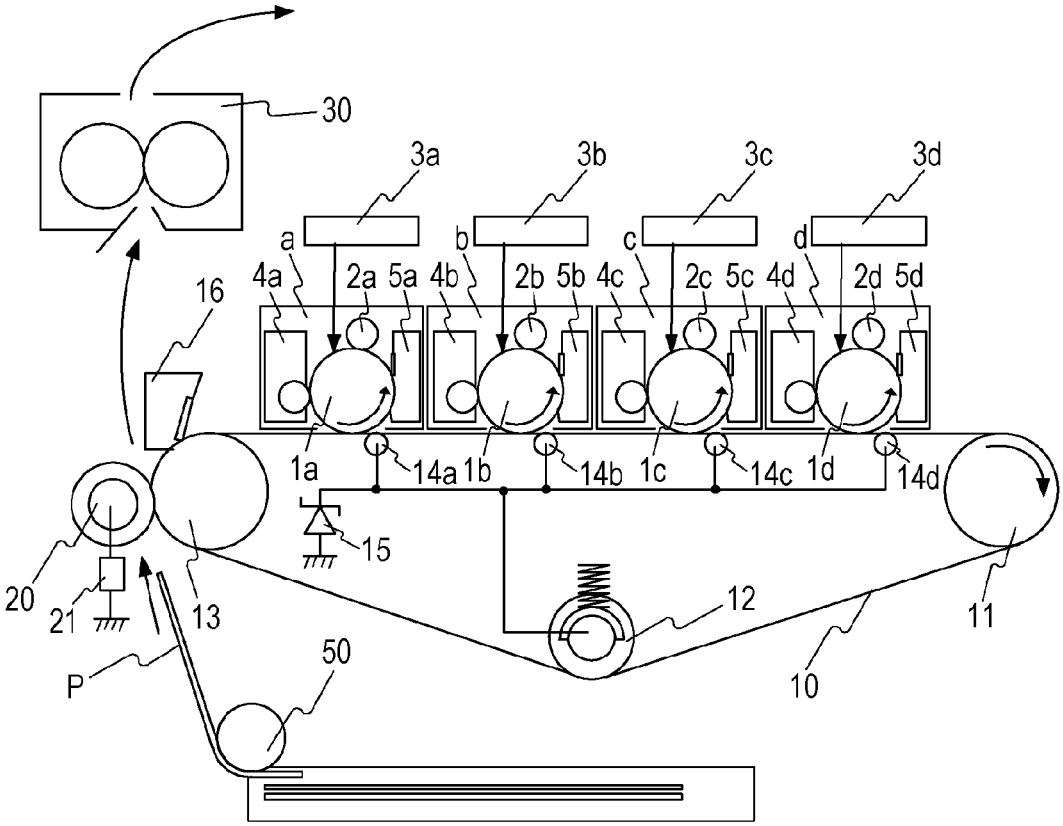
FIG. 10 illustrates an image forming apparatus according to another embodiment of the present subject matter.

The above-described embodiments have described a configuration in which the Zener diode 15, which is a voltage maintenance element, is connected to the opposing roller 13, which opposes the second transfer roller 20 serving as an electric-current supplying member. However, the Zener diode 15 may remain unconnected with the opposing roller 13. FIG. 10 illustrates an image forming apparatus according to another embodiment. As illustrated in FIG. 10, the image forming apparatus may have a configuration in which the opposing roller 13 and the driving roller 11 float electrically and the Zener diode 15 is connected to the tension roller 12 and the metal rollers 14*a*, 14*b*, 14*c*, and 14*d*. In the image forming apparatus illustrated in FIG. 10, the electric current supplied from the second transfer roller 20 is likely to rise at the time of second transfer. Thus, the image forming apparatus having the configuration illustrated in FIG. 10 has a higher effect of suppressing acceleration of abrasion of the photoconductor drum 1*a* than the image forming apparatus according to the first embodiment or the second embodiment as a result of lowering the electric current supplied in the case of the monochrome mode or the slow image formation mode.

Although a Zener diode is described as an example of a voltage maintenance element, the use of a varistor may be similarly effective.

The invention is not limited to the above-described embodiments and allowed to be changed or modified in various manners without departing from the spirit and the scope of the invention. Thus, the scope of the invention is set forth in the appended claims to make it public.

The present invention is capable of adjusting the electric current supplied from a second transfer member to suppress acceleration of abrasion of photoconductor drums while maintaining the second transfer efficiency at a desired level.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Publication No. PCT/JP2014/081850 filed Dec. 2, 2014, which is hereby incorporated by reference herein in its entirety.

The invention claimed is:

1. An image forming apparatus, comprising:

a plurality of photoconductors that carry toner images;

an endless intermediate transfer member that is rotatable and to which the toner images are first-transferred from the plurality of photoconductors;

a plurality of contact members disposed at positions corresponding to the plurality of photoconductors, the plurality of contact members coming into contact with an inner circumferential surface of the intermediate transfer member;

a second transfer member that comes into contact with an outer circumferential surface of the intermediate transfer member and second-transfers the toner images from the intermediate transfer member to a transfer medium;

a stretching member that stretches the inner circumferential surface of the intermediate transfer member;

a voltage maintenance element connected to the plurality of contact members and the stretching member and maintaining a surface potential of the intermediate transfer member; and a controller that is operable in a color mode and a monochrome mode, the color mode being a mode in which toner images, first-transferred to the intermediate transfer member from the plurality of photoconductors using an electric current supplied from the second transfer member in a state where all the plurality of photoconductors are in contact with the intermediate transfer member, are second-transferred to a transfer medium, and the monochrome mode being a mode in which a toner image, first-transferred to the intermediate transfer member from only a specific one of the photoconductors using an electric current supplied to the second transfer member in the state where all the plurality of photoconductors are in contact with the intermediate transfer member, is second-transferred to a transfer medium, wherein the voltage maintenance element maintains potentials of the plurality of contact members and the stretching member at a predetermined potential when an electric current flows from the second transfer member through the intermediate transfer member and the stretching member at a predetermined electric current or higher, wherein a first electric current supplied from the second transfer member to the intermediate transfer member when the controller is operated in the monochrome mode is lower than a second electric current supplied from the second transfer member to the intermediate transfer member when the controller is operated in the color mode, and wherein the first electric current is an electric current is higher than or equal to the predetermined electric current.

2. The image forming apparatus according to claim 1, wherein an absolute value of the first electric current is equal to an absolute value of the predetermined electric current.

3. The image forming apparatus according to claim 1, wherein the intermediate transfer member is an intermediate transfer belt having electric conductivity, and wherein an electric current supplied to one of the plurality of photoconductors disposed closest to the second transfer member as a result of causing an electric current to flow from the second transfer member in a circumferential direction of the intermediate transfer belt is lower in a case where the controller is operated in the monochrome mode than in a case where the controller is operated in the color mode.

4. The image forming apparatus according to claim 1, wherein the voltage maintenance element is a Zener diode.

5. The image forming apparatus according claim 1, wherein, when a toner image is first-transferred from one of the photoconductors to the intermediate transfer member, a corresponding one of the contact members supplies an electric current to the photoconductor through the intermediate transfer member.

6. The image forming apparatus according to claim 1, wherein the stretching member is an opposing member that opposes the second transfer member with the intermediate transfer member interposed therebetween.

7. An image forming apparatus, comprising:

a plurality of photoconductors that carry toner images;

an endless intermediate transfer member that is rotatable and to which the toner images are first-transferred from the plurality of photoconductors;

a plurality of contact members disposed at positions corresponding to the plurality of photoconductors, the plurality of contact members coming into contact with an inner circumferential surface of the intermediate transfer member;

a second transfer member that comes into contact with an outer circumferential surface of the intermediate transfer member and second-transfers the toner images from the intermediate transfer member to a transfer medium;

a stretching member that stretches the inner circumferential surface of the intermediate transfer member;

a voltage maintenance element connected to the plurality of contact members and the stretching member and maintaining a surface potential of the intermediate transfer member; and a controller that is operable in a first image formation mode and a second image formation mode, the first image formation mode being a mode in which toner images are second-transferred from the intermediate transfer member to a transfer medium at a first image formation speed, and the second image formation mode being a mode in which toner images are second-transferred from the intermediate transfer member to a transfer medium at a second image formation speed lower than the first image formation speed, wherein an electric current supplied from the second transfer member to the intermediate transfer member when the controller is operated in the second image formation mode is lower than an electric current supplied from the second transfer member to the intermediate transfer member when the controller is operated in the first image formation mode, wherein the voltage maintenance element maintains potentials of the plurality of contact members and the stretching member at a predetermined potential when an electric current flows from the second transfer member through the intermediate transfer member and the stretching member at a predetermined electric current or higher, and wherein an absolute value of the electric current supplied from the second transfer member to the intermediate transfer member when the controller is operated in the second image formation mode is equal to an absolute value of the predetermined electric current.

8. The image forming apparatus according to claim 7, wherein the intermediate transfer member is an intermediate transfer belt having electric conductivity, and wherein an electric current supplied to one of the plurality of photoconductors disposed closest to the second transfer member as a result of causing an electric current to flow from the second transfer member in a circumferential direction of the intermediate transfer belt is lower in the case where the controller is operated in the second image formation mode than in the case where the controller is operated in the first image formation mode.

9. The image forming apparatus according to claim 7, wherein the voltage maintenance element is a Zener diode.

10. The image forming apparatus according to claim 7, wherein, when a toner image is first-transferred from one of the photoconductors to the intermediate transfer member, a corresponding one of the contact members supplies an electric current to the photoconductor through the intermediate transfer member.

11. An image forming apparatus, comprising:

a plurality of photoconductors that carry toner images;

an endless intermediate transfer member that is rotatable and to which the toner images are first-transferred from the plurality of photoconductors;

a contact member disposed at a position corresponding to the plurality of photoconductors, the contact member coming into contact with an inner circumferential surface of the intermediate transfer member;

a second transfer member that comes into contact with an outer circumferential surface of the intermediate transfer member and second-transfers the toner images from the intermediate transfer member to a transfer medium;

a stretching member that stretches the inner circumferential surface of the intermediate transfer member;

a voltage maintenance element connected to the contact member and the stretching member and maintaining a surface potential of the intermediate transfer member; and a controller that is operable in a color mode and a monochrome mode, the color mode being a mode in which toner images, first-transferred to the intermediate transfer member from the plurality of photoconductors using an electric current supplied from the second transfer member in a state where all the plurality of photoconductors are in contact with the intermediate transfer member, are second-transferred to a transfer medium, and the monochrome mode being a mode in which a toner image, first-transferred to the intermediate transfer member from only a specific one of the photoconductors using an electric current supplied to the second transfer member in the state where all the plurality of photoconductors are in contact with the intermediate transfer member, is second-transferred to a transfer medium, wherein the controller performs control so that a first electric current amount, which is an amount of an electric current supplied from the second transfer member to the intermediate transfer member in a case where the monochrome mode is executed, is smaller than a second electric current amount, which is an amount of an electric current supplied from the second transfer member to the intermediate transfer member in a case where the color mode is executed.

* * * * *